US006726794B2

(12) United States Patent
Belt

(10) Patent No.: US 6,726,794 B2
(45) Date of Patent: Apr. 27, 2004

(54) APPARATUS AND METHOD FOR PRODUCING A MERCHANDISER AND A PRE-LOADED MERCHANDISER PRODUCED THEREBY

(75) Inventor: James G. Belt, Holland, OH (US)

(73) Assignee: Rudolph Foods Company, Inc., Lima, OH (US)

( * ) Notice: Subject to any disclaimer, the term of this patent is extended or adjusted under 35 U.S.C. 154(b) by 0 days.

(21) Appl. No.: 10/221,900

(22) PCT Filed: Mar. 15, 2001

(86) PCT No.: PCT/US01/40301

§ 371 (c)(1),
(2), (4) Date: Sep. 16, 2002

(87) PCT Pub. No.: WO01/67926

PCT Pub. Date: Sep. 20, 2001

(65) Prior Publication Data

US 2003/0192640 A1 Oct. 16, 2003

(51) Int. Cl.[7] ..... B32B 31/00

(52) U.S. Cl. ..... 156/265; 156/253; 156/302; 156/513; 156/522; 156/552; 156/566; 156/567; 156/568; 248/317; 53/393; 206/736

(58) Field of Search ..... 156/252, 253, 156/265, 302, 513, 518, 520, 521, 522, 530, 552, 566, 567, 568; 248/317; 53/393; 206/736

(56) References Cited

U.S. PATENT DOCUMENTS

| | | | | | |
|---|---|---|---|---|---|
| 1,909,841 | A | | 5/1933 | Perryman | 156/261 |
| 2,272,623 | A | * | 2/1942 | Runner | 206/80 |
| 3,331,182 | A | * | 7/1967 | Hannon | 53/35 |
| 3,850,724 | A | | 11/1974 | Lehmacher | 156/201 |
| 4,817,805 | A | | 4/1989 | Rodriquez | 211/85.15 |
| 5,433,060 | A | * | 7/1995 | Gur et al. | 53/413 |

FOREIGN PATENT DOCUMENTS

JP 10-28630 2/1998

* cited by examiner

*Primary Examiner*—Linda Gray
(74) *Attorney, Agent, or Firm*—David C. Purdue; John C. Purdue

(57) ABSTRACT

A pre-loaded disposable merchandiser (10), apparatus for producing merchandiser (10), and method for producing merchandiser (10). Merchandiser (10) includes strip (30), hanger (46) at one end of strip (30), and a plurality of items (12) connected to strip (30) in staggered locations. The apparatus includes strip material feeder (36), tape applicator (80) to apply piece (72) of tape (60) to a portion of strip (30) and a portion of an items (12). Items (12) may be heat sealed to strip (30) instead of taped. The method includes registering items (12) with strip (30) with items (12) being heat sealed to strip (30) or taped to strip (30). Merchandiser (10) is then cut from strip (30).

15 Claims, 11 Drawing Sheets

APPARATUS AND METHOD FOR PRODUCING A MERCHANDISER AND A PRE-LOADED MERCHANDISER PRODUCED THEREBY

BACKGROUND OF THE INVENTION

1. Field of the Invention

The present invention relates generally to merchandisers, articles useful for displaying a plurality of items for sale, typically positioned in retail outlets to maximize impulse purchasing. More specifically, the present invention is concerned with a pre-loaded, disposable merchandiser, as well as apparatus and a method for producing such merchandisers.

2. Description of the Prior Art

Strip merchandisers are known. Many comprise a strip of material having means for suspending the strip from the top and a plurality of hooks or fingers for supporting an apertured item offered for sale. These types of merchandisers are reusable. After the merchandise has been removed, new merchandise is hung from the strip. This is a time consuming task for delivery people and clerks who reload these strips. Breakage is a frequent problem with commercial, reusable merchandisers requiring replacement.

During a search of the Patent and Trademark Office web site bibliographic patent database, directed to the present invention, the following patents were noted: U.S. Pat. No. 3,954,049 (Brieske) entitled Method of Making Flexible Bag; U.S. Pat. No. 4,378,903) (Sherwood) entitled Hanging Tab With Single Line of Adhesive and Hanging Hole Clear of Adhesive; U.S. Pat. No. 4,546,943 (Fast) entitled Strip Merchandiser; U.S. Pat. No. 4,767,012 (Simmons) entitled Strip Hanger; U.S. Pat. No. 4,817,805 (Rodriquez) entitled Apparatus for Securing. Displaying and Dispensing of Envelope Package Goods; U.S. Pat. No. 4,823,489 (Cea) entitled Method of Making a Three Dimensional Composite Display Card; U.S. Pat. No. 4,911,392 (Fast) entitled Strip Merchandiser with Reinforcement Section; U.S. Pat. No. 5,199,578 (Pendergraph et al.) entitled Clip Strip for Supporting Multiple Packages and Display Assembly Using Same; U.S. Pat. No. 5,248,036 (Radocha, Sr., et al.) entitled Strip Type Point-of-Sale Display Unit; U.S. Pat. No. 5,284,259 (Conway, et al.) entitled Two Sided Merchandising Strip; U.S. Pat. No. 5,339,967 (Valiulis) entitled Strip Merchandiser; U.S. Pat. No. 5,386,916 (Valiulis) entitled Adjustable Strip Merchandiser; U.S. Pat. No. 5,469,959 (Gummer) entitled Hosiery Display Package; U.S. Pat. No. 5,553,721 (Gebka) entitled Reversible Strip Merchandiser; U.S. Pat. No. 5,598,922 (Good) entitled Product Display Hanger; U.S. Pat. No. 5,678,699 (Gebka) entitled Strip Merchandiser Hanger and Label Holder; U.S. Pat. No. 5,683,003 (Gebka) entitled Strip Merchandiser Hanger and Label Holder; U.S. Pat. No. 5,762,212 (Pomerantz) entitled Display Strip Merchandiser; U.S. Pat. No. D412,721 (DeFelice) entitled Merchandising Strip; and U.S. Pat. No. 5,957,422 (Shea) entitled Reinforced Strip Display Assembly Capable of Supporting High Volumes of Smaller Impulse Merchandise.

The Rodriquez patent discloses apparatus for securing, displaying and dispensing envelope package goods. The apparatus comprises a securing strip, a masking strip and adhesive between the two strips. Adhesive for securing a package to the apparatus is applied to the securing strip and is presented through apertures in the masking strip so that packages may be pressed against the exposed adhesive, thereby releasably securing the package to the apparatus.

Thus, the Rodriquez apparatus comprises two strips and packages are secured directly to adhesive which, in turn, is secured directly to the securing strip. This requires fairly precise alignment between packages and apertures in the masking strip for securing packages to the strip.

SUMMARY OF THE INVENTION

The present invention is based upon discoveries of a pre-loaded, disposable merchandiser, of a machine for producing the merchandiser, of methods for producing the merchandiser, and of methods for displaying items to be sold. The merchandiser comprises a strip, a hanger at one end of the strip for suspending the strip from something, and a plurality of items to be offered for sale, adhesively connected or sealed to the strip in staggered locations on the strip. In a first embodiment, apparatus for producing the merchandiser comprises a strip material feeder operable to deliver or feed strip material to a station to which items to be sold are also delivered, a tape arm operable to advance tape, a tape cutter operable to cut off a piece of the tape, and an install pad operable to apply the piece of tape to a portion of the strip and to a portion of an item to be sold or to packaging for the item. In a method for producing the merchandiser with apparatus of the first embodiment, the items to be sold are delivered to the station of the apparatus and so is the strip material until a portion of the next item is adjacent to a portion of the strip material. Tape is advanced through the tape arm, and the tape cutter and the install pad are advanced to cut off a piece of the tape and to engage the piece of tape. The install pad is advanced to apply the piece of tape to a portion of the strip material and to a portion of the item or the packaging for the item. The strip material with the item secured thereto is advanced and a fresh portion of the strip material is delivered to the station. A new item is delivered to the station as well, and the previously recited steps are repeated so that a new piece of tape is applied to the fresh portion of the strip material and to a portion of the next item or packaging for the item. Additional items are secured to successive portions of the strip material until a desired number of items are supported on the strip. The strip material is cut to release a loaded merchandiser from the strip material. Preferably, an aperture is punched or another hanger is formed in the strip at the end from which it is desired to hang the strip. In the former case, the portion of the strip adjacent to the aperture constitutes a hanger which can support the merchandiser on a hook or the like. Other hangers may certainly be employed.

In a second embodiment of apparatus for producing a merchandiser, the tape arm, the tape cutter and the tape install pad are replaced with a heat element which heat seals a portion of an item or packaging for an item to a portion of the strip material which, preferably, is a heat seal tape or tabbing tape. In a method for producing the merchandiser with apparatus of the second embodiment, the items to be sold are delivered to the station of the apparatus and so is the strip material until a portion of the next item or packaging for the item is adjacent to a portion of the strip material. A heat element is advanced to heat the portion of the next item or packaging for the item, the adjacent portion of the strip material, or both, until the portion of the item or packaging for the item is adhered or secured to the portion of the strip material. The strip material with the item secured thereto is advanced and a fresh portion of the strip material is delivered to the station. A new item is delivered to the station as well, and the previously recited steps are repeated so that a portion of the new item or packaging for the item is secured to the fresh portion of the strip material. Additional items are secured to successive portions of the strip material until a desired number of items are supported on the strip. The strip material is, again, cut to release a loaded merchandiser from the strip material.

A merchandiser according to the present invention is disposable and comprises a minimal amount of material. A person charged with stocking items loaded on a merchandiser according to the present invention can stock a plurality of the items by hanging a single merchandiser.

In the case where the items to be secured to a strip to produce a merchandiser constitute snack foods packaged in bags by means of vertical form, fill and seal equipment, it may be desired to secure a portion of the sealed end of each bag to successive portions of the strip material. In that case, difficulty may be encountered because the sealed ends of one or more bags may be substantially non-planar so that the end of the bag doesn't lay flat against the portion of the strip material. This situation is addressed by apparatus, according to the instant invention, comprising a straightener for straightening the edge of a bag or the like, and a gripper for engaging the end of the bag so that the edge remains substantially straight. The straightener preferably comprises a pair of brush rollers that rotate in opposite directions. Preferably, the brush rollers are mounted on swing arms so that they can be pivoted from a first position in which the rollers are adjacent to each other and are operable to straighten the edge of the bag, to a second position in which they are positioned away from the edge of the bag. Preferably, a stop is mounted on the swing arms adjacent to the roller brushes and, when the swing arms are in the first position and a bag edge passes between the brush rollers, the bag edge is advanced by the action of the brush rollers until it engages the stop. At that instant, a gripper engages the end of the bag, the swing arms and the stop are moved to the second position, and the gripped bag is advanced to position a portion of the edge adjacent to a target portion of the strip material for taping or heat sealing thereto.

Accordingly, it is an object of the present invention to provide a pre-loaded merchandiser which makes restocking an item as simple as hanging the merchandiser somewhere.

It is a further object of the present invention to provide an apparatus for producing the merchandiser which is pre-loaded with items to be sold.

It is yet another object of the present invention to provide a method for producing a pre-loaded merchandiser.

These and other objects and advantages of the present invention will no doubt become apparent to those skilled in the art after having read this detailed description of the invention including the following description of the preferred embodiment which is illustrated by the various figures of the drawing.

DETAILED DESCRIPTION OF THE PREFERRED EMBODIMENTS

Figure 1:
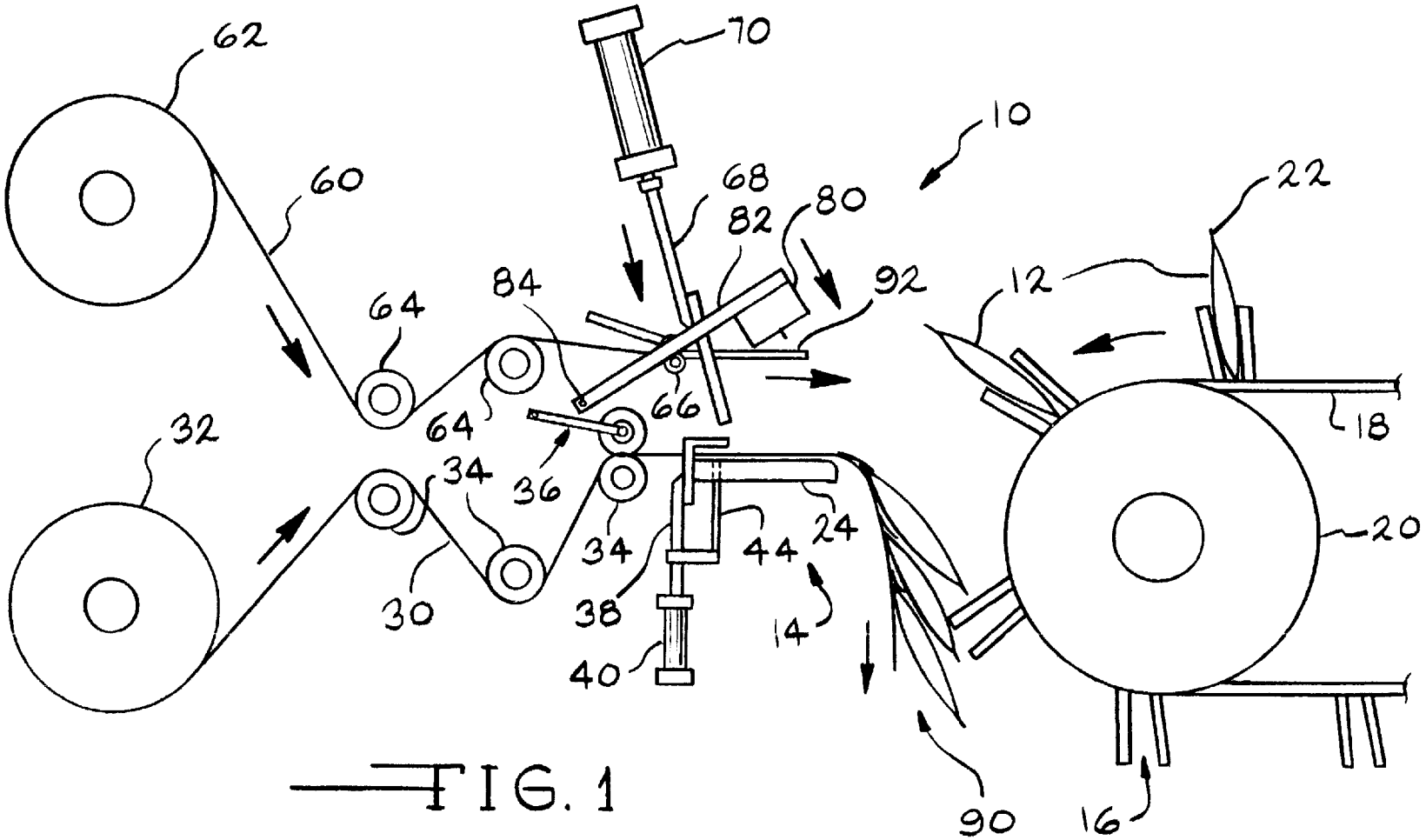
FIG. 1 is a side view of apparatus according to the present invention for producing pre-loaded merchandisers, as strip material and tape are advanced to a station.

Referring to FIGS. 1 through 4, apparatus according to the present invention for producing a pre-loaded merchandiser indicated generally at 10. Items 12 are advanced towards a station, indicated generally at 14. The items 12 can be one of thousands of products from pork rinds to tape, to aspirin, to antacids, and beyond. In FIGS. 1 through 4, the items 12 are illustrated as being snack bags each having flattened sealed ends 22.

The items 12, in the illustrated embodiment, are carried in pockets 16 which support the items 12 on a conveyor 18 which turns around a roller 20. It will be appreciated that certain economies of manufacture can be realized if items 12 are supplied to the apparatus 10 as they are produced, i.e., in-line with the manufacturing and/or packaging of a product constituting the items 12. In any case, the items 12 are advanced, right to left in FIGS. 1 through 4, towards the station 14, until an end 22 of a next item N (FIG. 1) is supported on a base 24.

Strip material 30 is supplied from a roll 32 and passes over rollers 34 and is delivered to the station 14 where a portion of it is supported on the base 24. An advancer, indicated generally at 36, is operable, in a first mode, and inoperable, in a second mode, to advance a new portion of the strip material 30 into the station. It will be appreciated that the advancer may further comprise a counter or sensor (not shown) to provide information about the position of the strip material 30 in the apparatus 10. The strip material may comprise a polymeric material. A preferred strip material is a thin polyester film and it can have a thickness of 7 thousandths of an inch. A suitable width is one and one half inches. These dimensions can be varied widely, within the scope of the present invention, depending on the requirements of a particular application.

Figure 4:
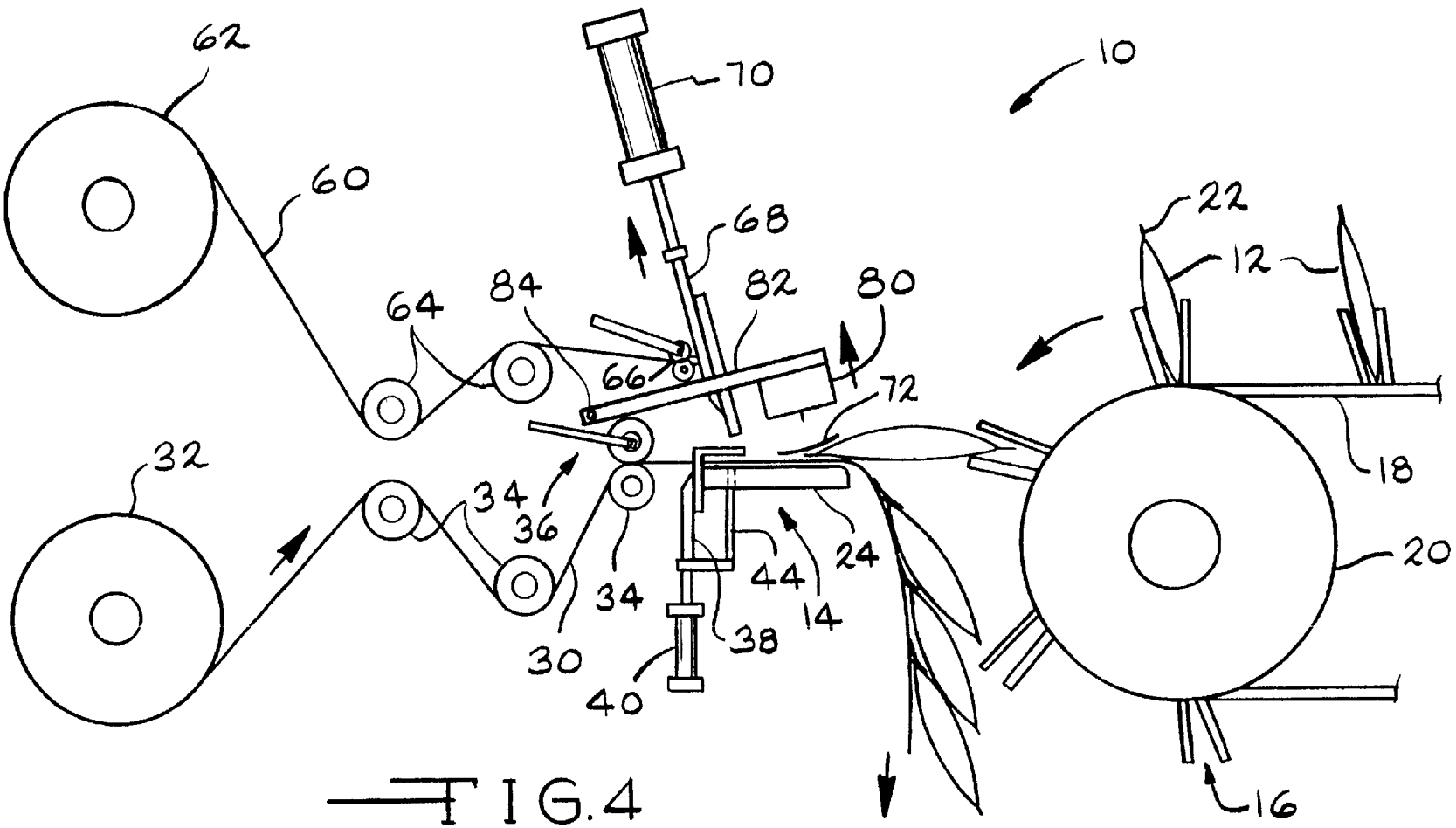
FIG. 4 is a side view of the apparatus shown in FIGS. 1 through 3 as a new item is delivered to the station, strip material is advanced and the install pad is withdrawn along with the tape cutter.
Figure 5:
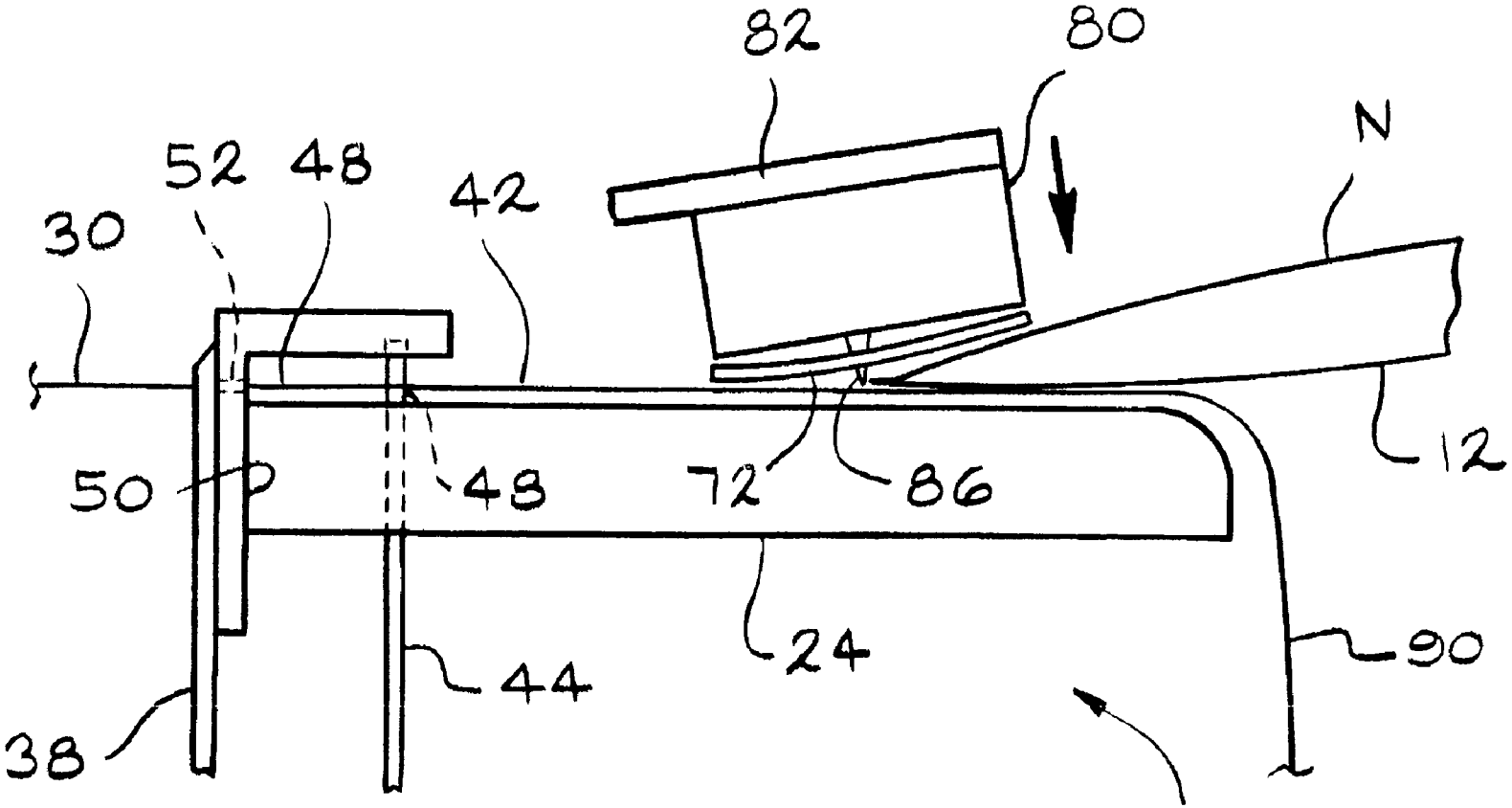
FIG. 5 is a detail view of a portion of the apparatus shown in FIGS. 1 through 4, as the install pad applies a piece of tape to portions of the strip material and to the item, and a pre-loaded merchandiser is severed from the strip material.
Figure 6:
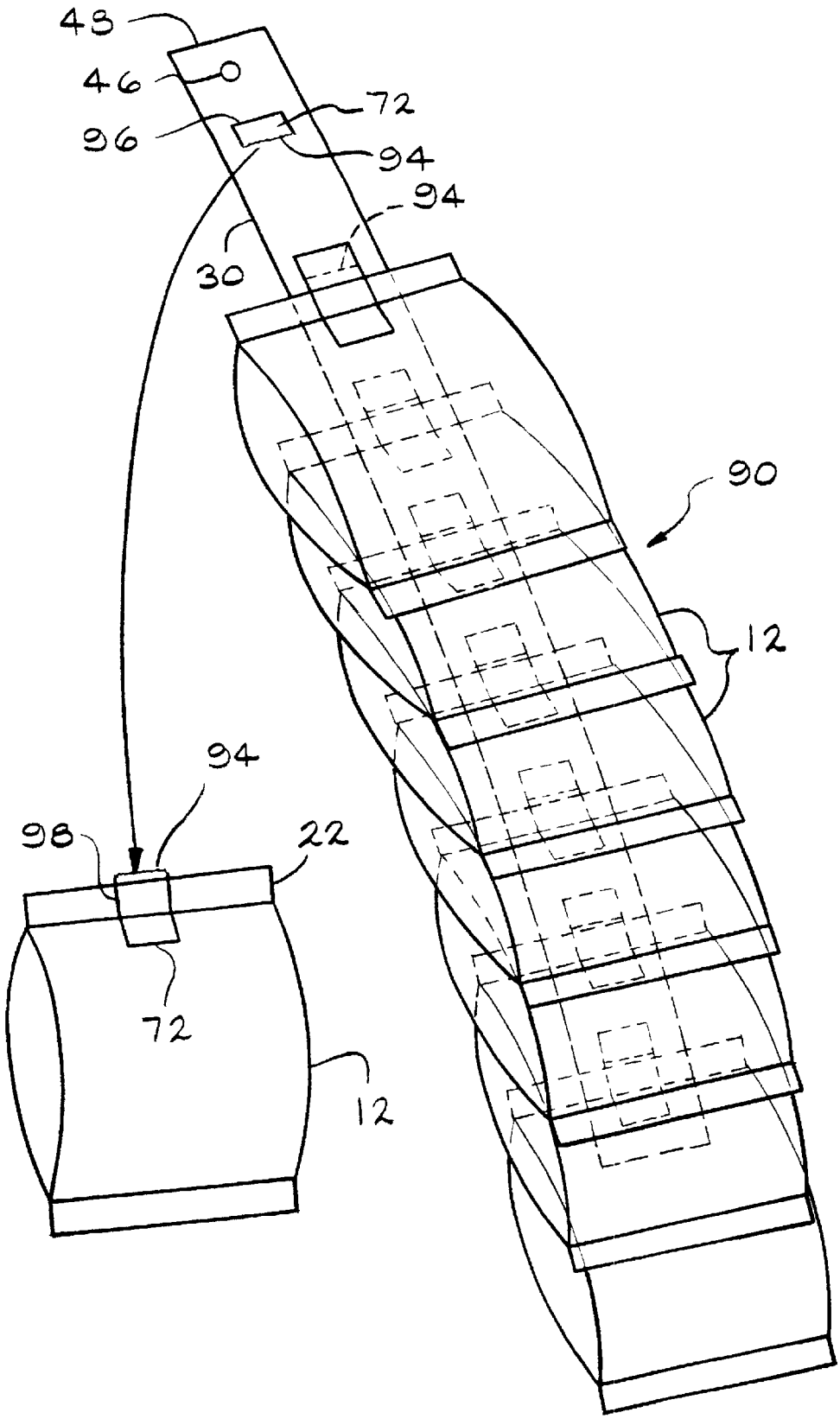
FIG. 6 is a perspective view of a merchandiser according to the present in invention.

The apparatus 10 further comprises a strip material cutter 38 for cutting strip material 30. The cutter 38 is supported on an actuator 40 for reciprocating movement between a first, retracted position (FIGS. 1 through 4) and a second, extended position (FIG. 5). Referring to FIG. 5, in traveling from the first position to the second position, the cutter 38 is operable to cut through the strip material 30, severing a strip 42 from the strip material 30. A punch 44 is supported on the actuator 40 (FIGS. 1 through 4) for reciprocating movement with the cutter 38 between a first, retracted position (FIGS. 1 through 4) and a second, extended position (FIG. 5). In moving from the first to the second position, the punch 44 is operable to form a hole 46 (FIGS. 5 and 6) in the strip 42, near a first end 48 thereof. An anvil 50 including a strip guide 52, is supported on the base 24 and cooperates with the cutter 38 and the punch 44 in a known fashion.

Tape 60 is supplied from a roll 62, passes over rollers 64 and is delivered to the station 14. The tape also passes through a tape advancer comprises cooperating V-drive serrated pulleys 66 which advance the tape 60, as needed, into the station 14. Counters and/or sensors (not shown) may be associated with the tape delivery system to provide information about the position of the tape 60 in the apparatus 10. A suitable, single sided adhesive tape is one available from 3M under the designation 375. It is about one inch wide. Many adhesive tapes are suitable for use in producing merchandisers according to the present invention.

Figure 2:
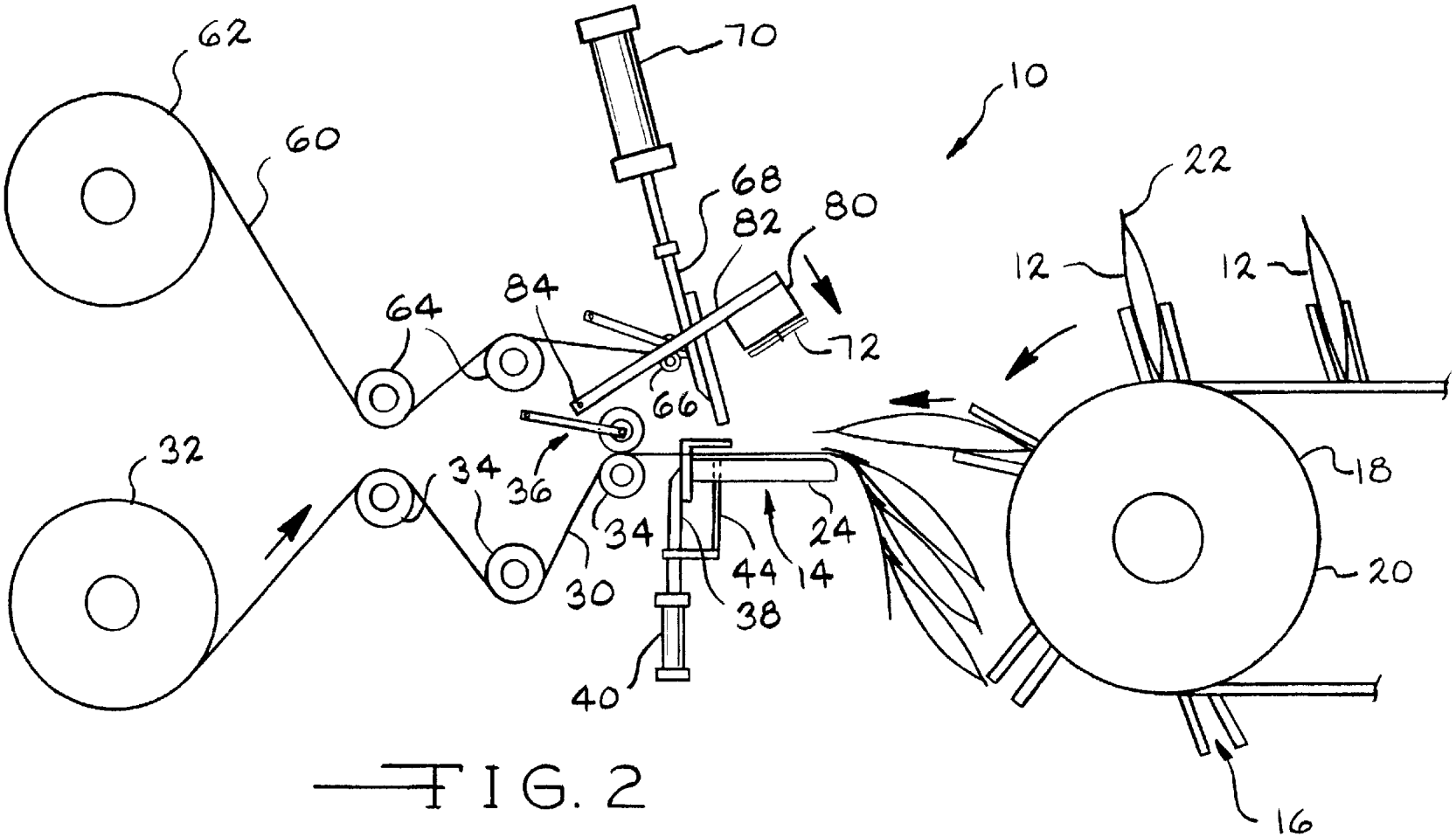
FIG. 2 is a side view of the apparatus shown in FIG. 1 as a piece of tape is cut from a tape and held on an install pad.
Figure 3:
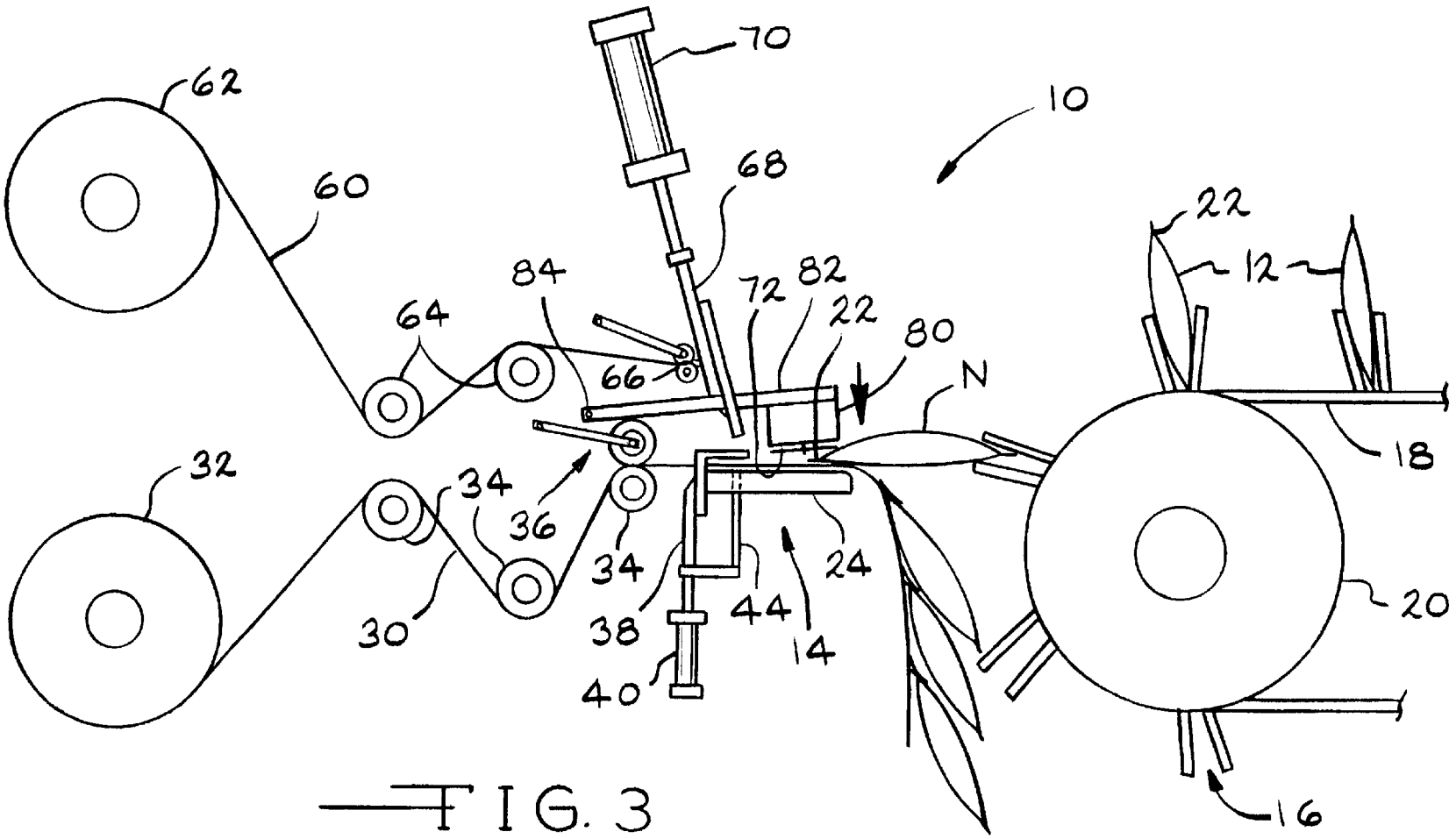
FIG. 3 is a side view of the apparatus shown in FIGS. 1 and 2 as the piece of tape is applied to a portion of the strip material and to a portion of an item.

The apparatus 10 further comprises a tape cutter 68 for cutting tape 60. The cutter 68 is supported on an actuator 70 for reciprocating movement between a first, retracted position (FIG. 1) and a second, extended position (FIGS. 2 through 4). In traveling from the first position to the second position, the tape cutter 68 is operable to cut through the tape 60, severing a piece of tape 72 from the tape 60.

A tape install pad 80 is supported on an arm 82 which is supported for pivotal movement about a pivot support 84 between a first, retracted position (FIGS. 1 and 2) and a second, extended position (FIG. 3). In moving from the first to the second position, the install pad 80 is operable to engage and hold the piece of tape 72 after it is severed from the tape 60. The install pad 80 can be provided with a vacuum tape retainer system (not shown) or other means for holding a piece of tape momentarily. The install pad should be made of a relatively resilient material so that a fairly uniform pressure is applied to the tape piece 72. A perf cutter 86 (best seen in FIG. 5) is supported on the install pad 80, if desired, for reasons discussed below.

The operation of the apparatus 10 to produce a merchandiser 90 (FIG. 6) will now be described. In FIG. 1, there is a portion of a merchandiser 90 hanging down from the right side of the base 24. First, the steps involved in adding a next item 12 to the partial merchandiser 90 will be set forth.

After an item 12 has been taped to the strip material 30, the install pad arm 82 pivots to the first, retracted position shown in FIG. 1. The tape 60 is advanced, left to right, by and between the V-drive serrated pulleys. An end portion 92 of the tape extends to the right of the V-drive pulleys 66. Although the end 92 is suspended in air, it has a V-shape in cross section and is self-supporting. The strip material 30 is also advanced, left to right, until the last item taped to the strip material is removed from the station 14, as shown in FIG. 1. A next item 12 is advancing, in a pocket 16, right to left, towards the station 14.

In FIG. 2, the apparatus is illustrated after the next item 12 has advanced into the station and after the tape cutter 68 has severed a piece of tape 72 from the tape 60. The piece of tape 72 has been engaged by and is now held by the install pad 80. From this state, the next item 12 is positioned on the strip material 30, as shown in FIG. 3 and the install pad arm 82 is advanced toward the second position until it applies the piece of tape to a portion of the strip material 30 and to a portion of the item 12. In this case, the piece of tape 72 is applied to the end 22 of the item 12. It is noted that in FIG. 3, where this state is illustrated, the tape piece 72, the strip material 30 and the end 22 of the item 12 have been spaced for clarity.

A next item can now be added to the strip material 30 or, if the previous item 12 was to be the last item, a pre-loaded merchandiser can be severed from the strip material 30. A next item 12 is added by returning the apparatus 10 to the FIG. 1 position. In FIG. 4, the apparatus 10 is illustrated in an intermediate state as the install pad arm 82 is returning to its retracted position. The previously attached item 12 is about to fall out of its pocket 16 and the strip material 30 is being advanced, left to right, to move the previously attached item 12 out of the station 14. As these actions continue, tape 60 is advanced, left to right, until a new end 92 is extended, and the FIG. 1 state is reached again. The preceding sequence can then be repeated until a desired number of items 12 have been taped to the strip material 30.

After the last item 12 for a given merchandiser has been attached to the strip material 30, the actuator 40 and the cutter 38 are advanced to the second position and, en route, the cutter 38 severs the strip material, creating a merchandiser 90. The punch 44 pierces the strip material 30, on the merchandiser side of the cut, producing a hole indicted at 46 in FIG. 6 near the end 48 of the merchandiser 90 which serves as a hanger for the merchandiser 90.

It will be appreciated that the control of the operation of the elements of the apparatus 10 may be carried out with known controllers, and it is specifically contemplated that micro-processors (not shown) may be utilized to control and regulate the operation of the apparatus 10. Such controllers are well known to those skilled in the art, as are the application of such controllers to control the apparatus 10 operations in the manner described above. Accordingly, such controllers will not be further described herein.

Returning now to FIG. 5, the perf cutter 86 will now be further described. The perf cutter 86 extends out of the face of the install pad 80 so that, when the install pad arm reaches the second, extended position, the perf cutter 86 perforates the tape piece 72, adjacent to the end 22 of the item 12, producing perforations. The perforations formed in the tape piece 72 serve to facilitate the removal of an item 12 from the merchandiser 90, as shown clearly in FIG. 6, where downward force applied to an item has cause the tape piece 72 to split into a first, strip portion 96, which remains on the merchandiser and a second, item portion 98, which remains on the item after it is removed from the merchandiser. For a given tape, a perf cutter call be selected that will perforate the tape piece 72 to the extent that the tape piece 72 is operable to hold items 12 fast to the strip 30 until a consumer exerts a comfortable, firm downward force on the item 12, causing the tape piece 72 to split and the item to be removed from the merchandiser 90 for sale. With the 3M tape referred to above, good results have been achieved with a perf cutter for producing dotted perforations which are a few thousandths of an inch in diameter and about sixty thousandths of an inch apart.

Figure 7:
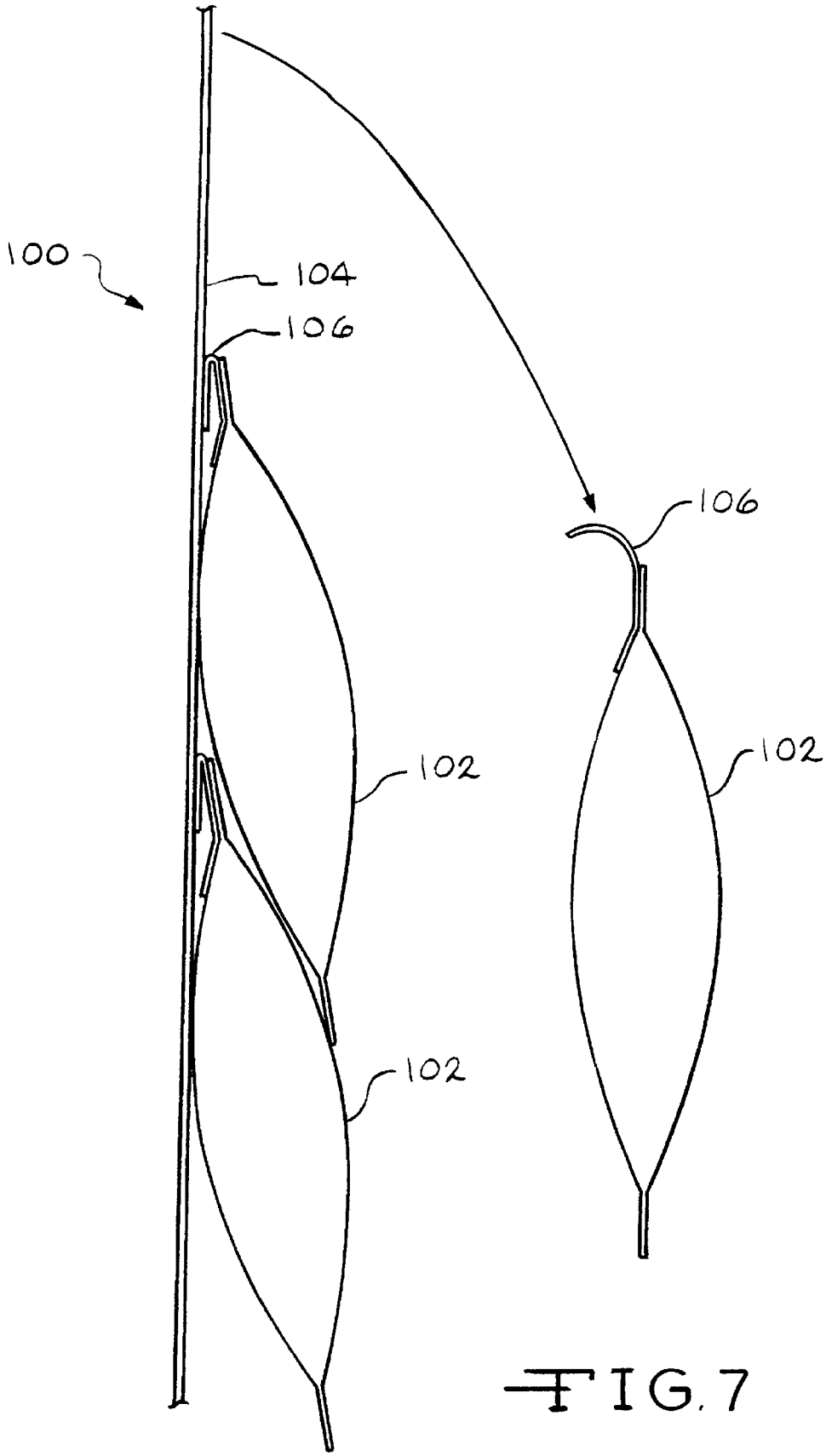
FIG. 7 is a side view of a second embodiment of a merchandiser according to the present invention.

Another embodiment of a merchandiser according to the present invention is indicated at 100 in FIG. 7. Items 102 are secured to a strip material 104 by tape pieces 106. The merchandiser 100 can be produced on apparatus corresponding with apparatus 10, if it is modified so that the positions of the cutter 38 and the punch 44 are reversed, whereby a hanger would be formed in what would be the upper end (not shown) of the merchandiser 100 as illustrated in FIG. 7, the end of a piece of strip material. It can be seen in FIG. 7 that the tape pieces 106 are folded over on themselves. These pieces 106 may be perforated or not, as desired.

Figure 8:
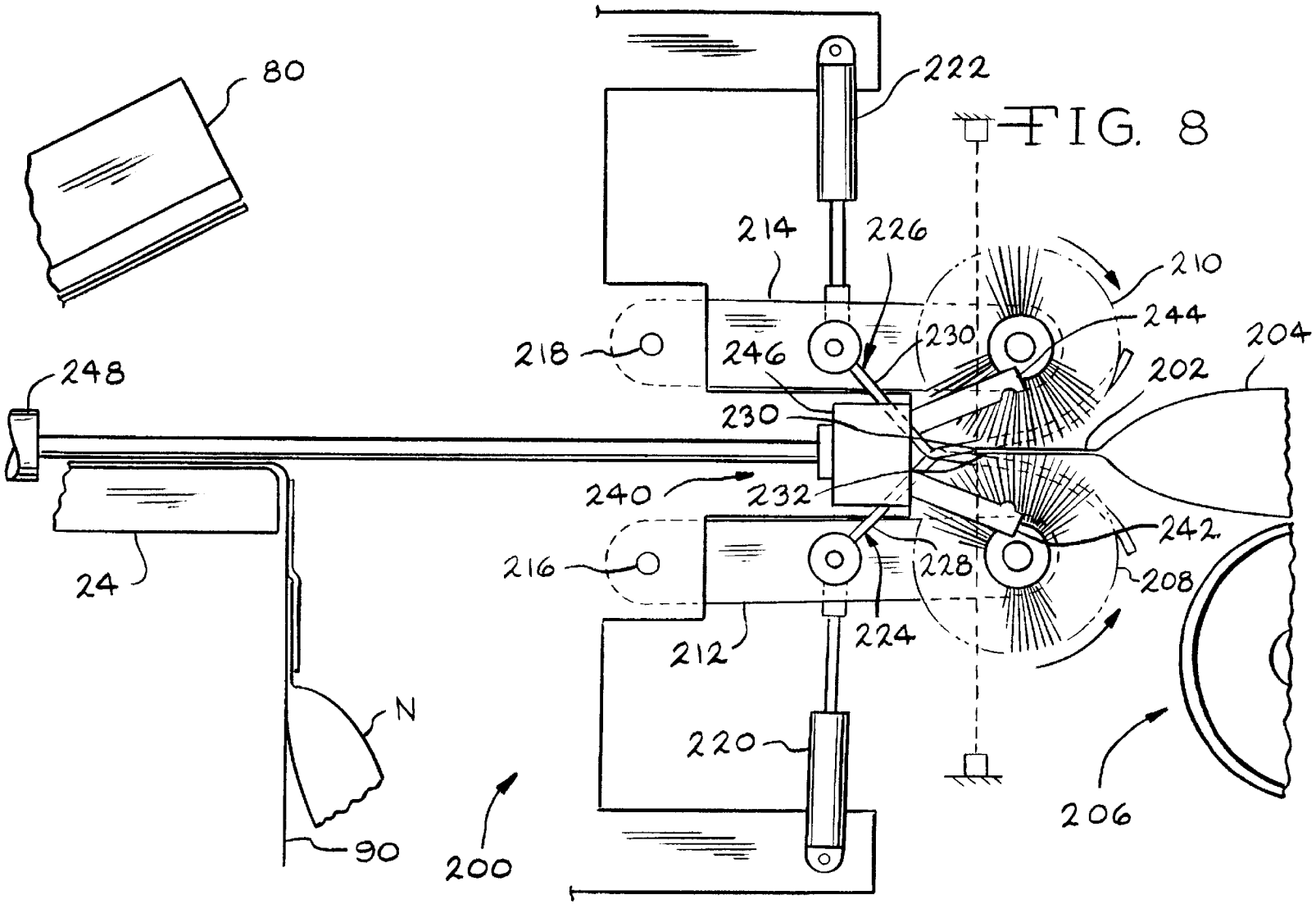
FIG. 8 is a side view of edge straightening apparatus according to the present invention as a bag is delivered thereto.

Referring now to FIG. 8, apparatus for straightening the lip or end of an item or of packaging for an item, is indicated generally it 200. The apparatus 200 is especially suited for straightening a sealed end 202 of a bag 204 which might contain a snack item. Such bags are typically formed, i.e., sealed at one end, filled with a product, and sealed, at the opposite end, in conventional equipment (not shown). Such bags 204, as they leave a form, fill and seal station, are not always of a uniform shape or configuration. Some bags will have leading ends 202 which are substantially planar and substantially parallel to a conveyor on which they are conveyed. Other bags 204 will have leading, and trailing, ends which are not substantially planar and/or which are cocked or skewed relative to a conveyor. In the latter case, the conveyor 18 with the pockets 16 (FIGS. 1 through 4) is not suitable for such bags because it is not capable of consistently positioning a desired portion of the edge of a bag on a target portion of a strip of material.

The edge straightening apparatus 200 is designed to receive snack bags 204 or the like from a conveyor 206. The apparatus 200 comprises a first, lower roller brush 208 and a second, upper roller brush 210 which are mounted on a lower arm 212 and an upper arm 214, respectively. The lower arm 212 is mounted for pivoting movement about a pivot 216 between a first, closed or stop position, shown in FIG. 8, to a second, open position shown in FIG. 10. Similarly, the upper arm 214 is mounted for pivoting movement about a pivot 218 between a first, closed or stop position, shown in FIG. 8, to a second, open position shown in FIG. 10. Movement of the lower arm 212 between the first and second positions is effected by a linear actuator 220 and a linear actuator 222 effects movement of the upper arm 214 between the first and second position. The roller brushes 208 and 210 are mounted on the arms 212 and 214 for rotation, in opposite directions, as indicated by arrows in FIG. 8. This effects a straightening of an end 202 of the bag 204 as it advances between the rollers 208 and 210. Individual bristles on the brush rollers 208 and 210 engage the sealed end 202 of the bag 204 and, as the rollers 208 and 210 rotate, the sealed end 202 of the bag 204 is pulled from left to right in FIG. 8.

An edge stop is provided by a pair of opposed sets of fingers which mesh together in a first position to catch or stop an edge. A first, lower set of fingers 224 is supported on the lower arm 212, adjacent to the pivot point 216, for movement therewith. A second, upper set of fingers 226 is supported on the upper arm 214, adjacent to the pivot point 218, for movement therewith. Working with a bag that is about five inches wide, good results have been achieved with a lower set of fingers 224 comprising four fingers, one of which is indicated at 228, each having generally the shape shown in FIG. 8. The fingers 228 are spaced from each other about three fourths of an inch. Preferably, the upper set of fingers 226 comprises four fingers, one of which is indicated at 230. Good results have been achieved on a bag that is about five inches wide, with an upper set of fingers comprising four fingers spaced apart about three fourths of an inch. The fingers of the upper and lower sets 226 and 224 are offset from each other so that a finger from the upper set 226 is between two fingers from the lower set 224, when looking down on the apparatus 200.

When the upper and lower sets of fingers 226 and 224 are in a first, closed position, as shown in FIG. 8, they intersect a line 230 which extends between the brush rollers 208 and 210. Accordingly, when rotation of the brushes 208 and 210 pulls the bag 204 from right to left, movement of the bag 204 is stopped when an edge 232 of the end 202 of the bag advances to the position shown in FIG. 8. i.e., the edge 228 is aligned with the line 230 at the intersection of the upper and lower sets of fingers 224 and 226.

Figure 9:
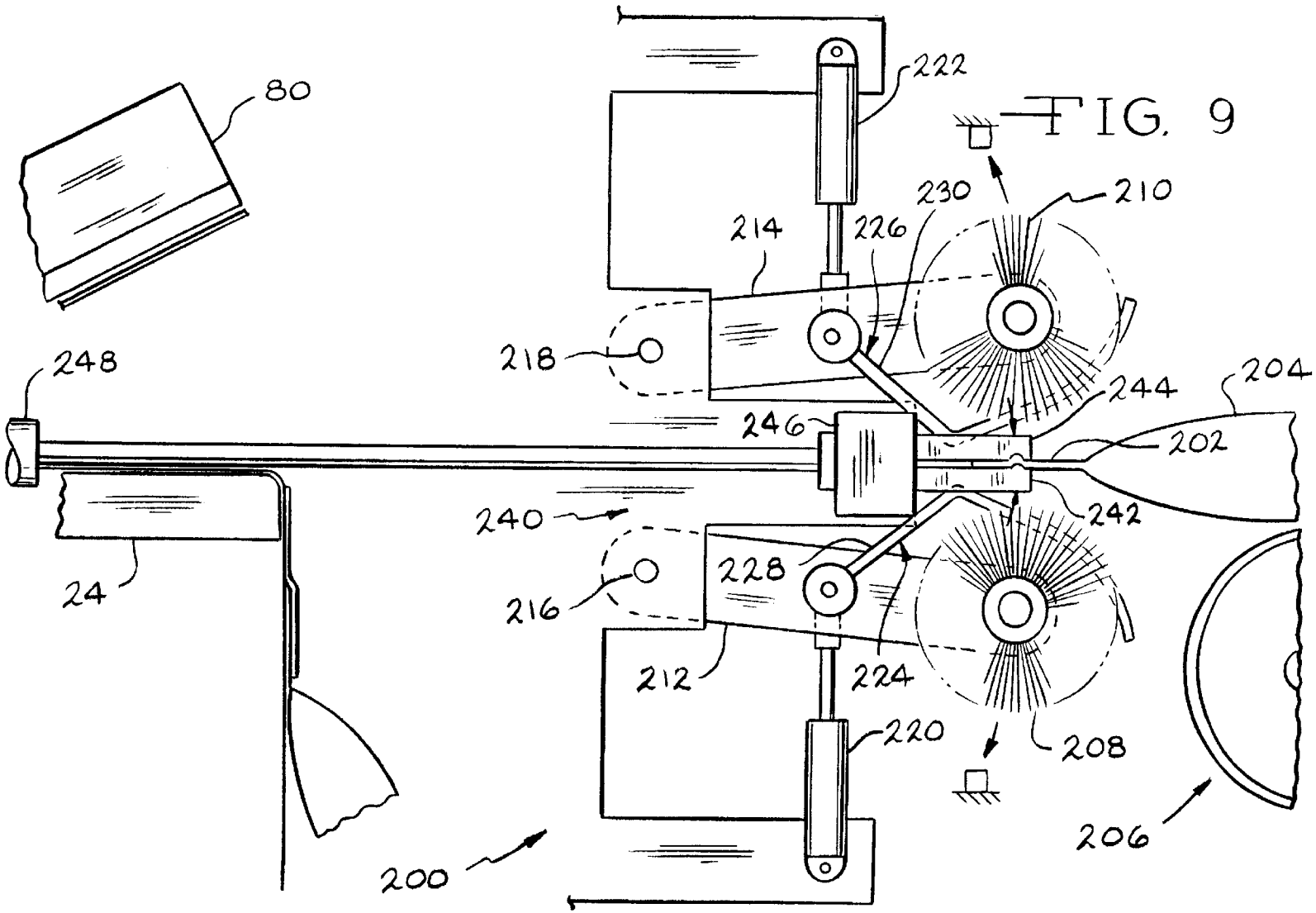
FIG. 9 is a side view of edge straightening apparatus according to the present invention as a gripper engages a straightened bag edge.
Figure 10:
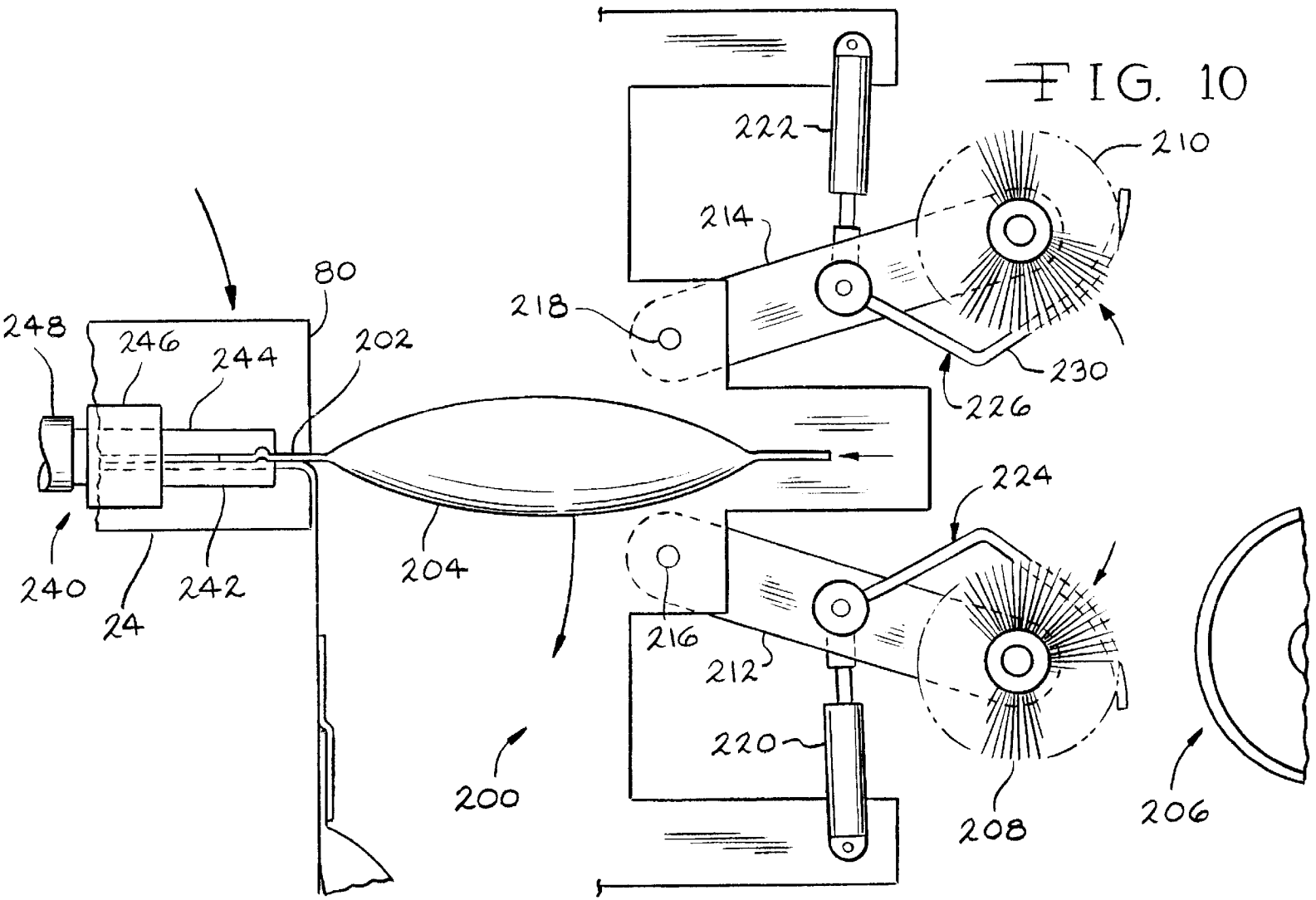
FIG. 10 is a side view of edge straightening apparatus according to the present invention after the gripper has positioned a portion of the straightened edge adjacent to a target portion of the strip material.

An end gripper indicated at 240 comprises a lower jaw 242 and an upper jaw 244, a jaw actuator 246 and a linear actuator 248. The jaw actuator 246 is operable to position the jaws 242 and 244 in a first, open position as shown in FIG. 8 and in a second, closed position as shown in FIGS. 9 and 10. Preferably, the lower jaw 242 and the upper jaw 244 each comprises a pair of spaced apart jaws so that, together, they are operable to rip two portions of the sealed end 202 of a bag 204 or the like, after it has been straightened by the action of the roller brushes 208 and 210. On a five-inch wide bag, good results have been achieved with a separation of about four inches for the upper, spaced apart jaws and a separation of about four inches for the lower, spaced apart jaws. Further, the upper and lower jaws 244 and 242 are positioned so that they can extend between the lower and upper fingers 228 and 230, as shown in FIGS. 8 and 9. The linear actuator 248 is operable to move the jaw actuator 246 from a first, extended position as shown in FIGS. 8 and 9 and a second, retracted position as shown in FIG. 10.

The operation of the apparatus 200 to deliver an end of something, which is to be attached to strip material, will now be described with reference to FIGS. 8 through 10. The sealed end 202 of the bag 204 is presented to the apparatus by a conveyor 206 so that the end 202 is directed generally between the roller brushes 208 and 210 which are rotating, as indicated by the arrows in FIG. 8, so that the end 202 is positively pulled in between the roller brushes 208 and 210, by the action of the brush roller bristles on the end 202 of the bag 204. The roller brushes 208 and 210 advance the end 202 of the bag, from right to left in FIG. 8, until the edge 232 of the end 202 reaches the line 232 at the intersection of the fingers 228 and 230. Upon the end 202 reaching this point, the roller brushes 208 and 210 are no longer operable to advance the end 202 to the left in FIG. 8, and the end 202 is held captive for a moment between the rotating roller brushes 208 and 210. This condition, which is preferably sensed by a sensor (not shown), signals the apparatus 200 to transfer the bag 204 to an attachment station with a base 24, with strip material positioned between the end 202 of the bag 204 and the base 24, as shown in FIG. 2.

The linear actuator 248 has previously been actuated to position the jaw actuator in the first, extended position shown in FIG. 8. The jaw actuator has been actuated to position the jaws in the first, open position illustrated in FIG. 8. A portion of the sealed end 202 is thus positioned between portions of the jaws 242 and 244.

Referring now to FIG. 9, the jaw actuator is actuated to move the jaws 242 and 244, as indicated by the arrows in FIG. 9, into the second, closed position so that the end 202 of the bag 204 is held captive between the jaws 242 and 244. At this time, the linear actuators 220 and 222 are actuated to move the lower and upper arms 212 and 214, and the roller brushes 208 and 210, from the first, closed position to the second, open position, as indicated by arrows in FIG. 9. As the roller brushes 208 and 210 reach the second, open position, which is illustrated in FIG. 10, there is clearance for the bag to be delivered to the base 24. This is accomplished with the actuation of the linear actuator 248 to move the jaw actuator 246, the jaws 242 and 244, and the bag retained thereby, to the second, retracted position shown in FIG. 10. In the retracted position, a portion of the end 202 of the bag 204 is brought into registration with a pre-selected portion of strip material for attachment thereto. The portion of the end 202 can be attached to the strip material by means of the apparatus shown in FIGS. 1 through 5, i.e., by taping. Alternatively, other attachments may be effected, either in the manner described below with reference to FIG. 11, or with other suitable attachment apparatus. At this stage, the apparatus 200 is reset as follows. Strip material with the bag 204 attached thereto is advanced, left to right, to position a new, pre-selected portion of the strip material on the base 24. The linear actuator 248 is actuated to move the jaw actuator 246 and the jaws 242 and 244 to the extended position. The roller brushes 208 and 210 and the arms 212 and 214 are moved, under the action of the actuators 220 and 22, to the closed position shown in FIG. 8. The apparatus is now set for another bag 204 to be advanced into the apparatus, between the roller brushes 208 and 210, and the foregoing cycle is repeated until a desired number of bags have been attached to the strip material. At that time, as described above, the strip material is cut to produce a loaded merchandising strip. Preferably, a hanger is formed in or on the strip, as described above.

Figure 11:
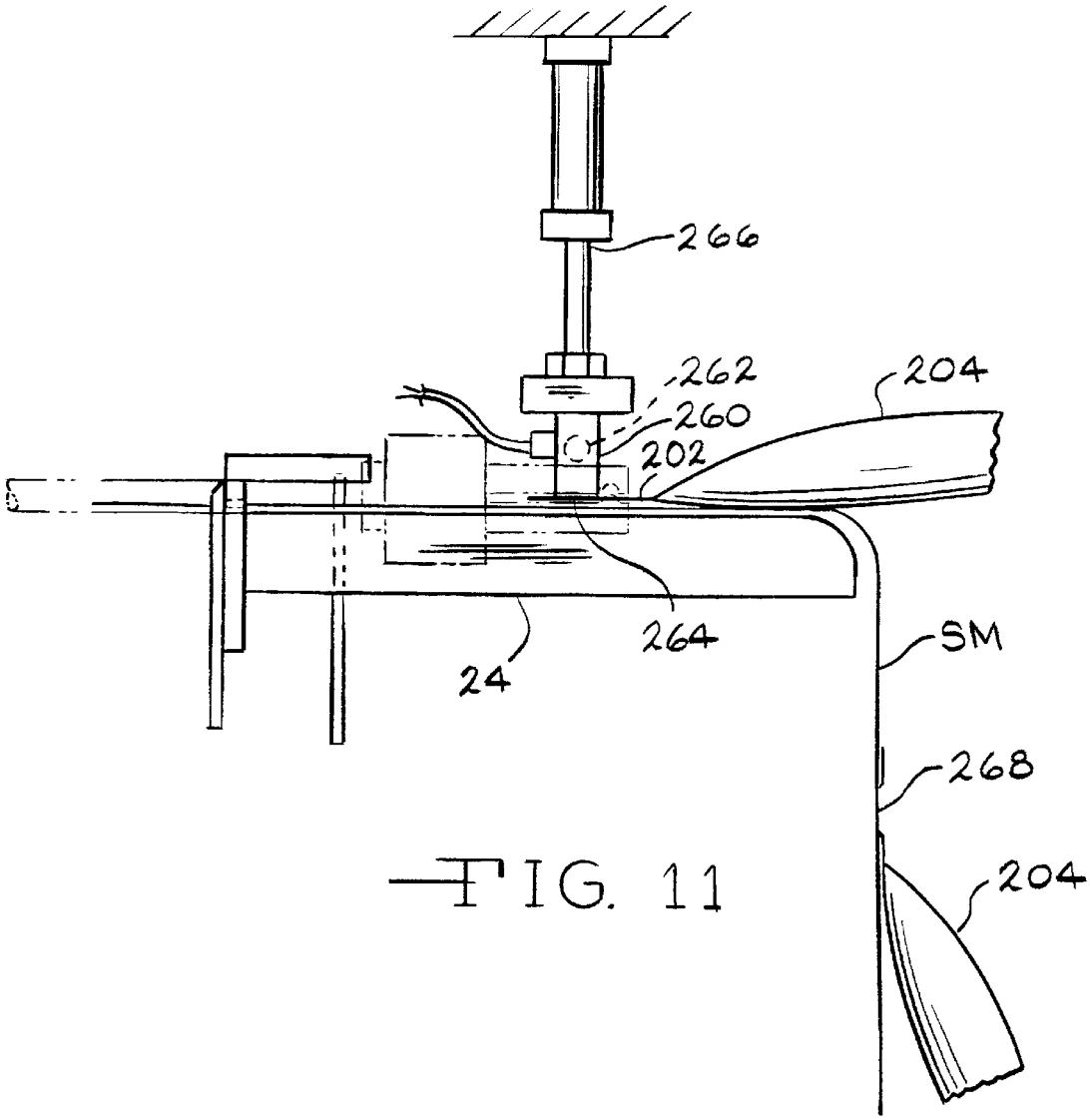
FIG. 11 is a partial side view of apparatus according to the present invention including a heat element for securing a portion of the edge of a bag to a target portion of the strip material.

In a second embodiment of apparatus for producing a merchandiser, the tape arm, the tape cutter and the tape install pad in the apparatus 10 shown in FIGS. 1 through 5 and/or the apparatus 200 shown in FIGS. 8 through 10, are replaced with other elements for attaching or securing a plurality of items to strip material to produce a merchandiser according to the present invention. Referring now to FIG. 11, a sealed end 202 of a bag 204 is resting on strip material SM which, in turn, is resting on the base 24. In this case, the strip material SM is heat seal tape or sealable tape to which the sealed end 202 is secured by the application of energy and, specifically, heat energy.

A heat bar 260 comprises a heating element 262 and a heat head 264. The heating element 262 heats the heat head 264 in a known manner and to a temperature sufficient that, when it is brought down to bear on the sealed end 202 of the bag as it rests upon the strip material SM, the end 202 and the strip material are sealed together, as indicated at 268, so that the bag 204 is supported on the strip material SM.

The heat bar is mounted on a linear actuator 266 which is operable to advance the heat bar 260 to a first, extended, sealing position which is illustrated in FIG. 11, and a second, retracted position which is higher than the position illustrated for the heat head 260 in FIG. 11. The heat bar only needs to be retracted a small distance to provide clearance for another end to be registered with the strip material SM.

In a method for producing the merchandiser with apparatus shown in FIG. 11, the items to be sold are delivered to the station of the apparatus and so is the strip material until a portion of the next item or packaging for the item is adjacent to a pre-selected portion of the strip material. The heat bar 260 is advanced to heat the portion of the next item or packaging for the item, the adjacent portion of the strip material, or both, until the portion of the item or packaging for the item is adhered, secured or attached to the portion of the strip material. The heat bar 260 is retracted and the strip material with the item secured thereto, is advanced and a fresh portion of the strip material is delivered to the station. A new item is delivered to the station as well, and the previously recited steps are repeated so that a portion of the new item or packaging for the item is secured to the fresh portion of the strip material. Additional items are secured to successive portions of the strip material until a desired number of items are supported on the strip. The strip material is, again, cut to release a loaded merchandiser from the strip material.

The foregoing detailed description is intended to enable one skilled in the art to practice the present invention and it sets forth the best modes presently known to the inventor for carrying out the invention. It will certainly be appreciated that the true scope of this invention goes beyond the scope of the foregoing detailed description and that the scope of the invention is to be determined with reference to the following claims.

I claim:

1. In apparatus for producing a merchandiser comprising a strip to which items to be sold are adhesively secured, the improvement wherein said apparatus comprises end straightening means comprising a pair of rotating brush rollers for straightening the ends of items before they are adhesively attached to the merchandiser.

2. A method for producing a merchandiser which comprises a strip pre-loaded with a given number of items to be sold, said method comprising the steps of advancing a portion of strip material to a station, delivering one of the items to the station, cutting a piece of tape holding the cut piece of tape on an install pad, advancing the install pad to a point where it applies a first portion of the cut piece of tape to a portion of the item and applies a second portion of the cut piece of tape to a portion of the strip, perforating the piece of tape, and repeating the foregoing steps until the given number of items has been secured by tape to the strip.

3. The method claimed in claim 2 which additionally includes the step of cutting the strip after the items have been secured to the strip.

4. The method claimed in claim 2, which additionally includes the step of forming a hanger on the strip.

5. The method claimed in claim 3, which additionally includes the step of forming a hanger on the strip.

6. The method claimed in claim 5 wherein the cutting of the strip and the forming of the hanger are carried out in a single step.

7. The method claimed in claim 5 wherein the perforations are positioned adjacent to the first portion of the cut pieces of tape.

8. The method claimed in claim 7 wherein the perforations are positioned between the first and second portions of the cut pieces of tape.

9. A merchandiser pre-loaded with a given number of items to be offered for sale, the merchandiser comprising a strip of material a number of pieces of adhesive tape corresponding with the given number of items, each of said pieces of tape having a first portion which is adhesively secured to a portion of the item and a second portion which is secured to the strip, wherein the tape pieces are perforated along a line extending between or adjacent to said first and second portions of said tape.

10. The merchandiser claimed in claim 9, which further comprises a hanger at a first end of said strip.

11. A method for producing a merchandiser which comprises a strip pre-loaded with a given number of items to be sold, said method comprising the steps of advancing a portion of strip material to a station, straightening an end of an item by passing it between a pair of rotating brush rollers, delivering the item to the station, registering the end of the item with a pre-selected portion of said strip material, heating said portions to the extent that the item is bonded to the strip, and repeating the foregoing steps until the given number of items has been secured to the strip.

12. The method claimed in claim 11 wherein, after the end is straightened, the item is engaged in at least two places by a gripper and the end of the item is brought into registration with a portion of the strip material.

13. A method for producing a merchandiser which comprises a strip pre-loaded with a given number of items to be sold, said method comprising the steps of advancing a portion of strip material to a station, straightening an end of one of the items by passing it between a pair of rotating brush rollers, delivering the item to the station so that the end of the item registers with a pre-selected portion of the strip material, cutting a piece of tape holding the cut piece of tape on an install pad, advancing the install pad to a point where it applies a first portion of the cut piece of tape to a portion of the item and applies a second portion of the cut piece of tape to a portion of the strip, and repeating the foregoing steps until the given number of items has been secured by tape to the strip.

14. The method claimed in claim 13 wherein, after the end is straightened, the item is engaged in at least two places by a gripper and the end of the item is brought into registration with a portion of the strip material.

15. A method for producing a merchandiser which comprises a strip pre-loaded with a given number of items to be sold, said method comprising the steps of advancing a portion of strip material to a station, straightening an end of one of the items by passing it between a pair of rotating brush rollers, delivering the item to the station so that the end of the item registers with a pre-selected portion of the strip material, adhesively securing the end of the item to the pre-selected portion of the strip material, and repeating the foregoing steps until the given number of items has been secured by tape to the strip.

* * * * *